US010941597B2

(12) United States Patent
Lee et al.

(10) Patent No.: US 10,941,597 B2
(45) **Date of Patent: *Mar. 9, 2021**

(54) REFRIGERATOR

(71) Applicant: LG Electronics Inc., Seoul (KR)

(72) Inventors: Sunghun Lee, Seoul (KR); Dongjeong Kim, Seoul (KR); Jinho Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/752,380

(22) Filed: Jan. 24, 2020

(65) Prior Publication Data

US 2020/0157860 A1 May 21, 2020

Related U.S. Application Data

(63) Continuation of application No. 15/837,421, filed on Dec. 11, 2017, now Pat. No. 10,577,843.

(30) Foreign Application Priority Data

Mar. 29, 2017 (KR) ..... 10-2017-0039790

(51) Int. Cl.
*E05D 3/16* (2006.01)
*F25D 23/02* (2006.01)
(Continued)

(52) U.S. Cl.
CPC ..... *E05D 3/16* (2013.01); *E05D 3/14* (2013.01); *E05F 1/00* (2013.01); *E05F 15/616* (2015.01);
(Continued)

(58) Field of Classification Search
CPC .. E05F 15/616; E05F 1/00; E05D 3/16; E05D 3/14; Y10T 16/522; Y10T 16/533;
(Continued)

(56) References Cited

U.S. PATENT DOCUMENTS 6,338,536 B1 * 1/2002 Ueno ..... E05B 17/0033 312/405
6,711,856 B1 * 3/2004 Hoffman ..... E05F 1/105 296/207
(Continued)

FOREIGN PATENT DOCUMENTS

CN 101688412 3/2010
CN 106066112 11/2016
(Continued)

OTHER PUBLICATIONS

Chinese Office Action in Chinese Appln. No. 201880023061.6, dated Sep. 30, 2020, 17 pages (with English translation).
(Continued)

*Primary Examiner* — Janet M Wilkens
(74) *Attorney, Agent, or Firm* — Fish & Richardson P.C.

(57) ABSTRACT

A refrigerator includes a cabinet defining a storage compartment, a refrigerator door configured to open and close the storage compartment, a hinge assembly configured to couple the refrigerator door to the cabinet. The hinge assembly includes a first link rotatably coupled to the cabinet and a second link rotatably coupled to the refrigerator door. The refrigerator further includes a door opening device provided at the cabinet, and the door opening device includes a pushing member configured to push one of the first link or the second link to thereby open the refrigerator door.

14 Claims, 20 Drawing Sheets

(51) Int. Cl.
*E05F 1/00* (2006.01)
*E05D 3/14* (2006.01)
*E05F 15/616* (2015.01)

(52) U.S. Cl.
CPC ..... *F25D 23/028* (2013.01); *E05Y 2201/426* (2013.01); *E05Y 2201/686* (2013.01); *E05Y 2201/716* (2013.01); *E05Y 2900/31* (2013.01)

(58) Field of Classification Search
CPC ..... Y10T 16/557; Y10T 16/53826; Y10T 16/5383; E05Y 2201/426; E05Y 2201/686; E05Y 2201/716; E05Y 2900/31; F25D 23/028
USPC ..... 312/326–329, 405, 405.1; 49/276, 379
See application file for complete search history.

(56) References Cited

U.S. PATENT DOCUMENTS

| | | | | |
|---|---|---|---|---|
| 8,653,767 | B2 * | 2/2014 | Kim | G05B 19/042 318/282 |
| 9,995,066 | B1 * | 6/2018 | Ottolini | E05F 15/60 |
| 10,041,685 | B2 * | 8/2018 | Kim | F24C 15/023 |
| 10,364,599 | B2 * | 7/2019 | Lee | E05D 3/16 |
| 2009/0064463 | A1 * | 3/2009 | Gomoll | E05D 3/16 16/371 |
| 2010/0101052 | A1 | 4/2010 | Waltemate et al. | |
| 2011/0048060 | A1 * | 3/2011 | Kim | E05B 17/0029 62/449 |
| 2011/0068671 | A1 * | 3/2011 | Vanini | E05F 5/02 312/405 |
| 2011/0089801 | A1 * | 4/2011 | Bonomie | E05F 1/14 312/405 |
| 2013/0221825 | A1 * | 8/2013 | Bonomie | H01H 9/00 312/405 |
| 2016/0195325 | A1 * | 7/2016 | Kim | E05D 3/16 312/405 |
| 2016/0312516 | A1 * | 10/2016 | Heydel | H02K 7/116 |
| 2019/0169910 | A1 * | 6/2019 | Im | E05F 15/619 |
| 2019/0292934 | A1 * | 9/2019 | Nakamura | F01D 17/145 |

FOREIGN PATENT DOCUMENTS

| | | | |
|---|---|---|---|
| DE | 20102998 | | 6/2001 |
| DE | 102005004957 | * | 8/2006 |
| DE | 202007004621 | | 8/2008 |
| DE | 102008035926 | * | 2/2010 |
| DE | 202010015094 | * | 2/2012 |
| DE | 102005063588 | | 7/2013 |
| EP | 2218989 | * | 8/2010 |
| EP | 3086063 | | 10/2016 |
| EP | 3382304 | * | 3/2018 |
| JP | 2001055863 | | 2/2001 |
| JP | 2016011797 | | 1/2016 |
| KR | 20040105030 | | 12/2004 |
| KR | 101409605 | | 6/2014 |
| WO | WO2014154252 | | 10/2014 |
| WO | 2017219054 | * | 12/2017 |
| WO | 2018007240 | * | 1/2018 |

OTHER PUBLICATIONS

Extended European Search Report in European Appln. No. 18778180.2, dated Dec. 4, 2020, 8 pages.

* cited by examiner

REFRIGERATOR

CROSS-REFERENCE TO RELATED APPLICATIONS

This application is a continuation of U.S. application Ser. No. 15/837,421, filed on Dec. 11, 2017, which claims priority under 35 U.S.C. § 119 to Korean Patent Application No. 10-2017-0039790, filed in Korea on Mar. 29, 2017. The disclosures of the prior applications are incorporated by reference in their entirety.

FIELD

The present disclosure relates to a refrigerator.

BACKGROUND

A refrigerator is a home appliance that can keep objects such as food in a storage compartment provided in a cabinet at a low temperature. The storage compartment may be surrounded by an insulation wall such that the internal temperature of the storage compartment is maintained at a temperature lower than an external temperature.

The storage compartment may be referred to as a refrigerating compartment or a freezing compartment according to the temperature range of the storage compartment.

A user may open and close the storage compartment using a door. The user opens the door to put objects into the storage compartment or take objects out of the storage compartment. In some examples, the door is rotatably provided on the cabinet and a gasket is provided between the door and the cabinet.

In some examples, in a state of closing the door, the gasket is closely adhered between the door and the cabinet to prevent leakage of cool air from the storage compartment. As adhesion force of the gasket increases, the effect of preventing leakage of cool air may increase.

In some cases, in order to increase adhesion force of the gasket, the gasket may be formed of, for example, a rubber magnet or a magnet may be provided in the gasket. However, if adhesion force of the gasket increases, a large force may be required to open the door.

Recently, refrigerators having an auto closing function have been provided. For example, an auto closing function refers to a function for automatically closing the door of the refrigerator using adhesion force and magnetic force of the gasket and elastic force of a spring when the door of the refrigerator is slightly opened.

In some examples, the auto closing function may refer to a function for preventing the door of the refrigerator from being automatically opened even when the refrigerator is slightly tilted forward.

In some cases, recent refrigerators may require a large force to open a door as compared to refrigerators of the related art, because a user may need to pull the door with force larger than adhesion force and magnetic force of a gasket and elastic force of a spring.

Recently, a door opening device for automatically opening a door has been proposed.

In some examples, the refrigerator may include a door and a door opening device mounted in the door.

The door opening device may be provided in a cap decoration part of the door of the refrigerating compartment. In this case, it may difficult to increase the front-and-rear length of the door opening device to be greater than the front-and-rear length (thickness) of the door.

The door opening device may include a rack which can be withdrawn from and inserted into the door by driving a motor.

Driving power of the motor is delivered to the rack through a power delivery device. In some cases, the rack is withdrawn when the motor is driven in one direction and the rack is inserted when the motor is driven in the other direction.

In some examples, the power delivery device may include a plurality of gears and rotation power of the motor may be delivered to the rack by rotating the plurality of gears. In some cases, the rack includes a rack body and a rack gear formed in the rack body. Driving power of the motor is delivered to the rack through engagement between the gears and the rack gear.

In some examples, the rack may push a cabinet in a process of withdrawing the rack, thereby opening the door.

In this case, the door may be automatically opened in a state in which a user does not apply pulling force to the door.

The opening angle of the door may change according to the withdrawal distance of the rack. For example, the rack may have a curved shape, and the door may be automatically opened by about 25 degrees.

The door is automatically opened for a user to take food out of the storage compartment or to put food into the storage compartment without manually opening the door. Accordingly, the door may be opened to provide a space sufficient for the user to access the storage compartment.

However, when the door is opened by only about 25 degrees, the user may not satisfactorily use the refrigerator.

For example, when the door is automatically opened by about 25 degrees, the user may further open the door using the body or foot thereof while the user may hold objects in both hands. In this case, an unsanitary problem may occur and automatically opening the door may cause user inconvenience.

In some cases, it may be difficult to increase the withdrawal distance of the rack because the length of the rack is limited by the thickness of the door. For example, there may be a limitation in increase in the length of the rack due to restriction in the internal space of the door of the refrigerator. Therefore, there may be a limitation to how much the protrusion length of the rack may be increased.

SUMMARY

The present disclosure provides a refrigerator capable of utilizing a door opening device without changing the structure of the door opening device even when the opening direction of a refrigerator door is changed.

The present disclosure provides a refrigerator capable of preventing a door opening part from shaking when a door opening part opens the refrigerator.

The present disclosure provides a refrigerator capable of preventing noise due to friction between a door opening part and a hinge assembly in a process of opening a refrigerator door.

According to one aspect of the subject matter described in this application, a refrigerator includes a cabinet defining a storage compartment, a refrigerator door configured to open and close the storage compartment, a hinge assembly configured to couple the refrigerator door to the cabinet. The hinge assembly includes a first link rotatably coupled to the cabinet, and a second link rotatably coupled to the refrigerator door. The refrigerator further includes a door opening device provided at the cabinet, and the door opening device includes a pushing member configured to push one of the first link or the second link to thereby open the refrigerator door.

Implementations according to this aspect may include one or more of following features. The first link may be rotatably coupled to the second link. The pushing member may be configured, based on the pushing member pushing one of the first link or the second link, to move to an end position toward a front surface of the cabinet, and a distal end of the pushing member may be positioned rearward of the front surface of the cabinet based on the pushing member being at the end position. The first link may be rotatably coupled to the cabinet at a first hinge axis and to the second link at a second hinge axis, and the pushing member may be configured to push the first link at a contact point that is positioned closer to the second hinge axis than to the first hinge axis.

In some implementations, the first link may include a contact surface that is oriented parallel to the refrigerator door based on the refrigerator door being closed, and the contact point may be positioned at the contact surface. The hinge assembly may further include a third link that couples the first link to the refrigerator door. The third link may be rotatably coupled to the first link at a third hinge axis between the first hinge axis and the second hinge axis, and the contact point is positioned closer to the second hinge axis than the third hinge axis. In some examples, the hinge assembly may further include a first hinge frame fixed to the cabinet, and a second hinge frame fixed to the refrigerator door in which the first and second links connect the first hinge frame to the second hinge frame.

In some implementations, the first link may be rotatably connected to the first hinge frame, and the second link rotatably may connect the first link to the second hinge frame. The hinge assembly may further include a third link rotatably coupled to the first link and to the second hinge frame, and a fourth link rotatably coupled to the first hinge frame and to the third link in which the third and fourth links are located between the second link and the first hinge frame. In some examples, the first link may be rotatably coupled to the first hinge frame at the first hinge axis, and the second link may be rotatably coupled to the first link at the second hinge axis and to the second hinge frame at a sixth hinge axis. The third link may be rotatably coupled to the first link at the third hinge axis and to the second hinge frame at a seventh hinge axis, and the fourth link may be rotatably coupled to the third link at a fourth hinge axis and to the first hinge frame at a fifth hinge axis.

In some implementations, the fifth hinge axis may be located closer to the refrigerator door than to the first hinge axis. The seventh hinge axis may be located between the fifth hinge axis and the sixth hinge axis. In some examples, a length of the fourth link may be less than a length of the first link, and the fourth hinge axis may be located between the third hinge axis and the seventh hinge axis. In some cases, a distance between the second hinge axis and the third hinge axis is less than a distance between the sixth hinge axis and the seventh hinge axis. When the refrigerator door is closed, the sixth hinge axis and the seventh hinge axis may be located rearward of the fifth hinge axis. When the refrigerator door is opened, the sixth hinge axis and the seventh hinge axis may be located forward of the fifth hinge axis. In some implementations, when the refrigerator door is closed, the fifth, sixth, and seventh hinge axes are located on a plane parallel with a front surface of the cabinet.

According to another aspect of the subject matter described in this application, a refrigerator includes a cabinet defining a storage compartment, a refrigerator door configured to open and close the storage compartment, and a hinge assembly configured to couple the refrigerator door to the cabinet in which the hinge assembly includes a first link rotatably coupled to the cabinet, a second link rotatably coupled to the first link and to the refrigerator door, a third link rotatably coupled to the first link and to the refrigerator door, and a fourth link rotatably coupled to the third link and to the cabinet. The refrigerator further includes a door opening device provided at the cabinet in which the door opening device includes a pushing member configured to push one of the first link, the second link, or the third link to thereby open the refrigerator door.

Implementations according to this aspect may include one or more of following features. The first link may be rotatably coupled to the cabinet at a first hinge axis and to the second link at a second hinge axis, the third link may be rotatably coupled to the first link at a third hinge axis between the first hinge axis and the second hinge axis, the fourth link may be rotatably coupled to the third link at a fourth hinge axis between the third hinge axis and the refrigerator door, and the pushing member may be configured to push the first link at a contact point that is positioned closer to the second hinge axis than the third hinge axis.

In some implementations, the pushing member may be configured, based on the pushing member pushing one of the first link, the second link, or the third link, to move to an end position toward a front surface of the cabinet. In some examples, when the pushing member is at the end position, a distal end of the pushing member may be positioned rearward of the front surface of the cabinet.

DETAILED DESCRIPTION

Figure 1:
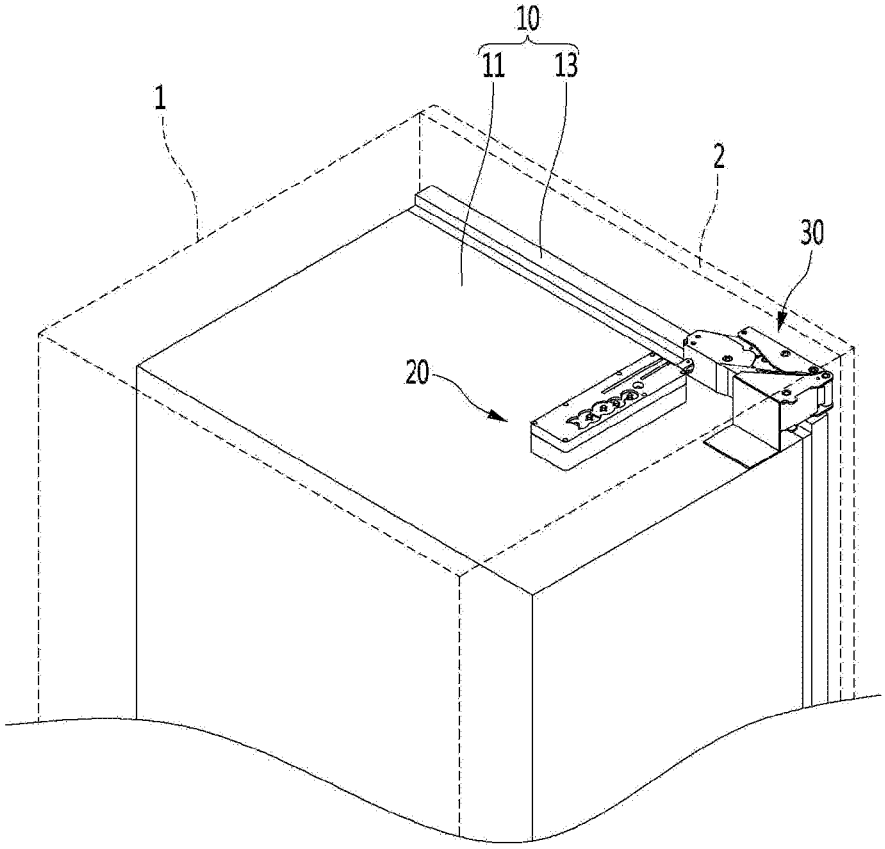
FIG. 1 is a view showing an example built-in refrigerator.
Figure 2:
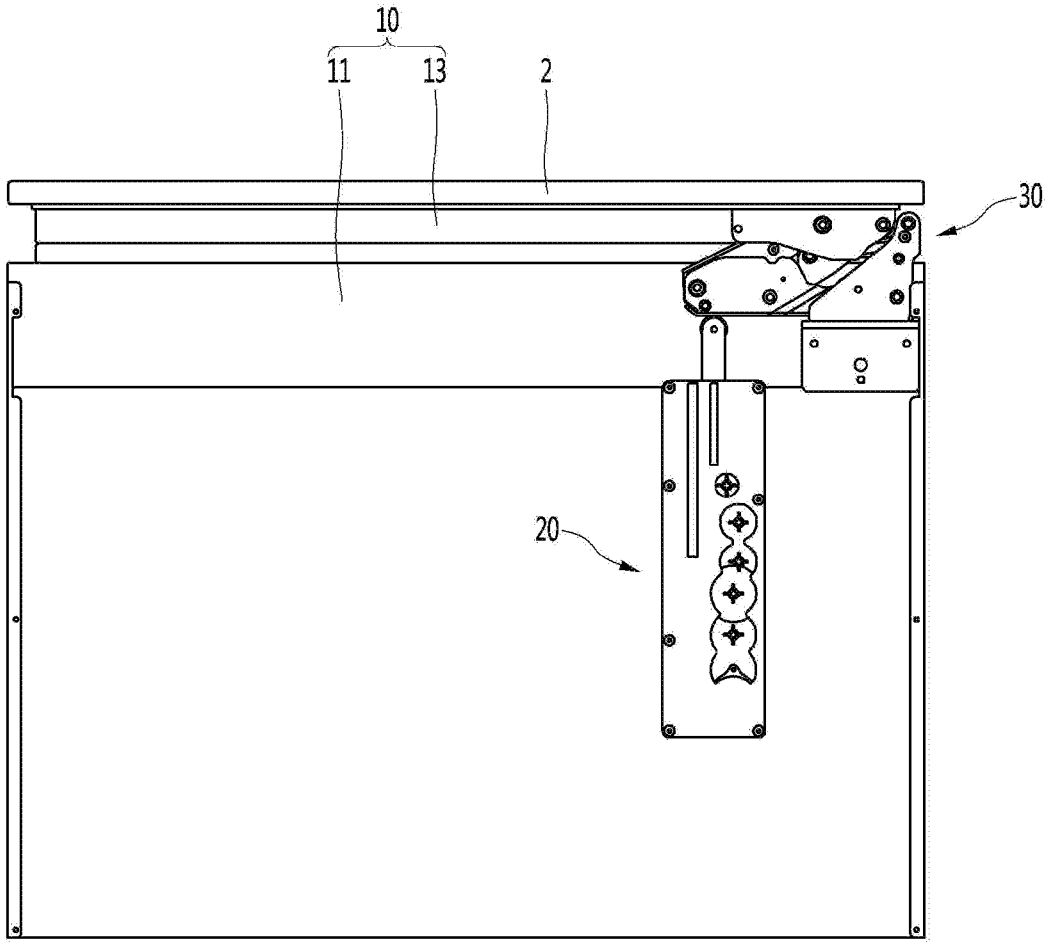
FIG. 2 is a plan view showing an example refrigerator.

FIG. 1 is a view showing an example built-in refrigerator, and FIG. 2 is a plan view showing an example refrigerator.

Referring to FIGS. 1 and 2, the refrigerator 10 may be built in kitchen furniture.

For example, furniture 1 may be mounted in a kitchen, a specific space, or other places, and the refrigerator 10 may be accommodated in the furniture 1. The furniture 1 may include a furniture door 2.

The refrigerator 10 may include a cabinet 11 including a storage compartment and a refrigerator door 12 for opening and closing the storage compartment.

The cabinet 11 is accommodated in the furniture 1 and the refrigerator door 12 may be connected to the furniture door 2.

When the furniture door 2 rotates, the refrigerator door 13 connected to the furniture door 2 may rotate to open the storage compartment.

In a state in which the refrigerator door 13 closes the storage compartment, the furniture door 2 may cover the refrigerator door 13 at the outside of the refrigerator door 13 to prevent exposure of the refrigerator door 13.

The refrigerator 10 may further include a hinge assembly 30 connected to the furniture door 2 or the refrigerator door 13 to rotate the furniture door 2 and the refrigerator door 13 together.

In some implementations, the hinge assembly 30 may be a multi joint hinge assembly including a plurality of links. The hinge assembly will be described with reference to the drawings. The hinge assembly 30 may further include a plurality of hinges each of which includes a hinge axis about which the hinge can rotate. For example, a first hinge includes a first hinge axis, and a second hinge includes a second hinge axis, and so on.

The refrigerator 10 may further include a door opening device 20 for pushing and operating the hinge assembly 30 to rotate the furniture door 2 and the refrigerator door 13 together.

The door opening device 20 may be provided at an upper surface of the cabinet 11. The door opening device 20 may be located at the rear side of the hinge assembly 30 in a state in which the refrigerator door 13 closes the storage chamber.

The door opening device 20 is driven in a predetermined condition or state. The refrigerator door 13 is automatically opened by driving the door opening device 20. Accordingly, force required for the user to open the door may be remarkably reduced or may not be required.

For example, if a sensor recognizes approach of a user, a user presses a specific or predetermined button or an opening command is input through a touch type input unit, the door opening device 20 may operate.

One side of the hinge assembly 30 may be connected to the furniture door 2 or the refrigerator door 13 and the other side thereof may be provided on the upper surface of the cabinet 11.

Although the refrigerator 10 built in the furniture is used in FIG. 1, the door opening device 20 and the hinge assembly 30 are applicable to the refrigerator 10 which is not built in furniture.

Hereinafter, the door opening device 20 will be described.

Figure 3:
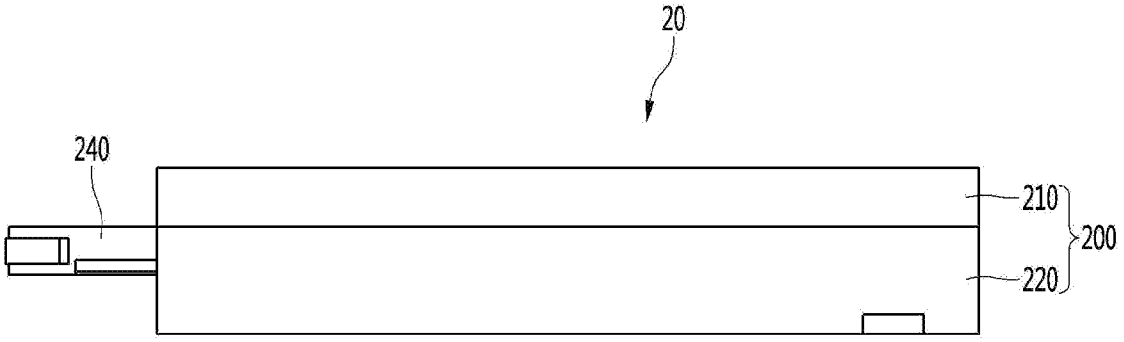
FIG. 3 is a side view showing an example door opening device.
Figure 4:
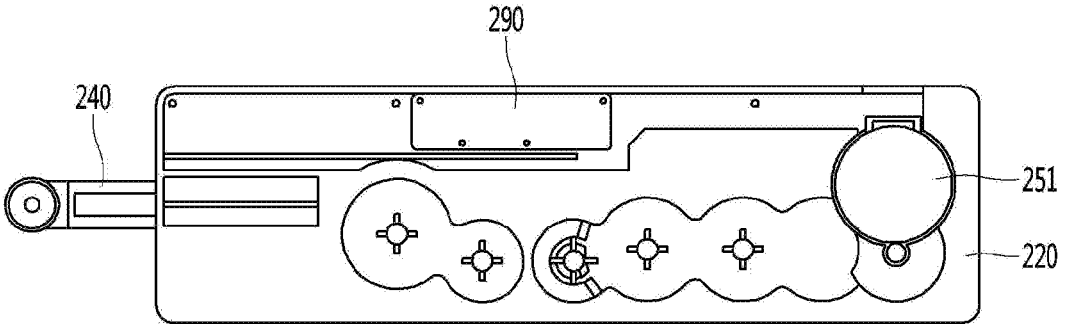
FIG. 4 is a bottom view showing an example door opening device.
Figure 5:
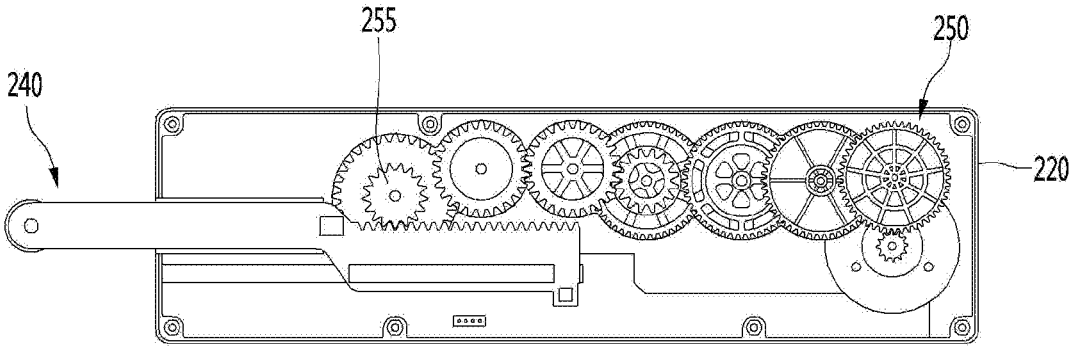
FIG. 5 is a plan view showing an example door opening device in a state of removing an upper frame.
Figure 6:
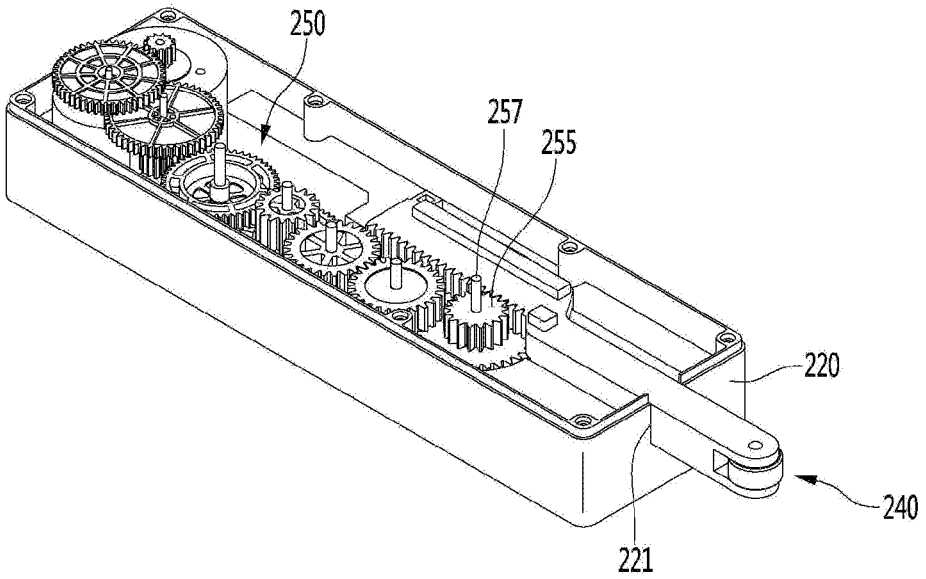
FIG. 6 is a perspective view showing an example door opening device in a state of removing an upper frame.
Figure 7:
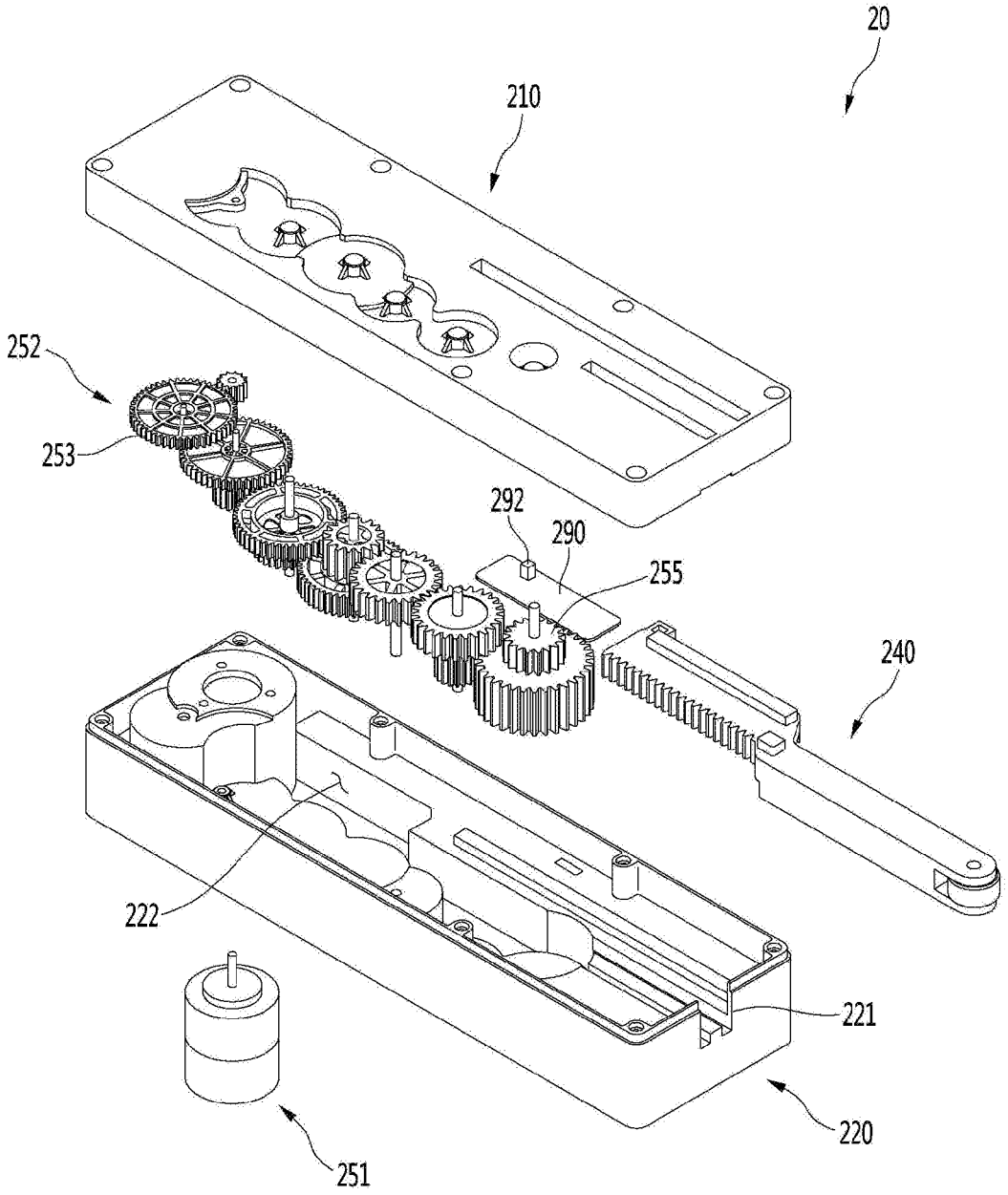
FIG. 7 is an exploded perspective view showing an example door opening device.

FIG. 3 is a side view showing an example door opening device, FIG. 4 is a bottom view showing an example door opening device, FIG. 5 is a plan view showing an example door opening device in a state of removing an upper frame, FIG. 6 is a perspective view showing an example door opening device in a state of removing an upper frame, and FIG. 7 is an exploded perspective view showing an example door opening device.

Referring to FIGS. 2 to 7, the door opening device 20 may include a driving unit 250 and a door opening part 240 operating using driving power received from the driving unit 250.

The door opening part 240 moves by driving power received from the driving unit 250 to push the hinge assembly 30.

The door opening device 20 may further include a frame 200 in which the driving unit 250 and the door opening part 240 are provided.

The frame 200 may include a lower frame 220 provided on the upper surface of the cabinet 11 and an upper frame 210 coupled to the lower frame 220.

The driving unit 250 and the door opening part 240 may be seated in the lower frame 220 and the upper frame 210 may cover the upper sides of the driving unit 250 and the door opening part 240.

The driving unit 250 may include a driving motor 251 and a power delivery part 252 for delivering power of the driving motor 251 to the door opening part 240.

The driving motor 251 may bidirectionally rotate, for example. The driving motor 251 may be mounted in the lower frame 220 from the lower side to the upper side of the lower frame 220. The power delivery part 252 may be mounted in the lower frame 220 from the upper side to the lower side of the lower frame 220.

The power delivery part 252 may include a plurality of gears 253. The gears 253 are reduction gears for reducing the rotation speed of the driving motor 251 and delivering the driving power of the door opening part 240 to the door opening part 240.

The plurality of gears 253 may include a connection gear 255 directly connected to the door opening part 240.

The door opening device 20 may include a PCB 290 for controlling the driving motor 251. The PCB 290 may be provided in the upper frame 220, without being limited thereto.

Since the driving motor 251 is mounted in the lower frame 220 from the lower side to the upper side of the lower frame 220, the PCB 290 may be mounted on the lower surface of the lower frame 220, for ease of connection between the PCB 290 and the driving motor 251. A Hall sensor 292 used to sense the position of the door opening part 240 may be provided on the PCB 290.

The Hall sensor 292 may sense the position of the door opening part 240 located in the frame 200. To this end, the Hall sensor 292 may be located in the frame 200 while penetrating the lower side of the lower frame 220.

Hereinafter, the structure of the frame 200 will be described in detail.

Figure 8:
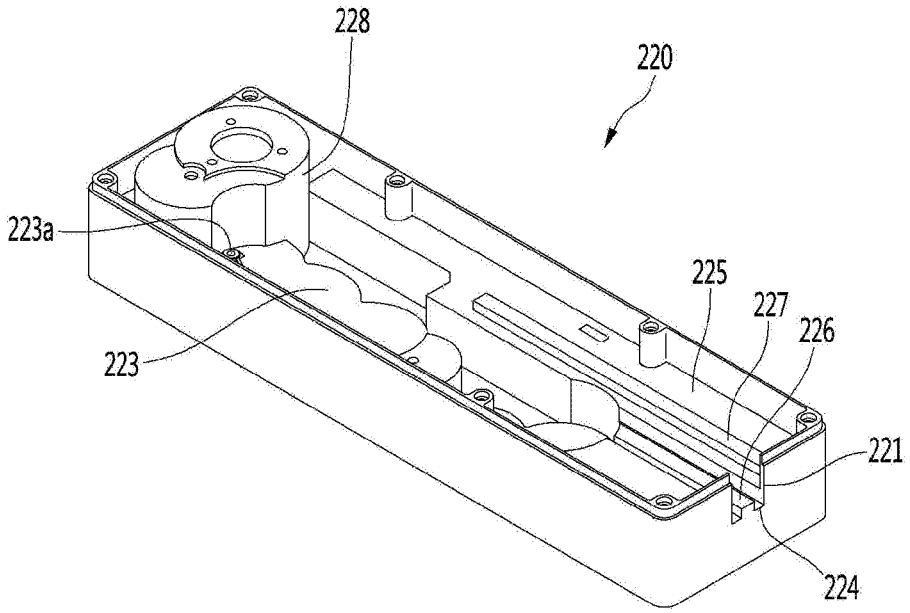
FIG. 8 is a perspective view showing an example lower frame.

FIG. 8 is a perspective view showing an example lower frame.

Referring to FIGS. 3 to 8, the lower frame 200 may include a gear reception space 222 for receiving the plurality of gears 253.

A gear supporter 223 rotatably supporting the plurality of gears 253 may be provided in the gear reception space 222.

The gear supporter 223 may include a plurality of shaft connectors 223*a* rotatably supporting shafts 257 for rotating the plurality of gears 253.

The lower frame 220 may include a slot 221, through which a portion of the door opening part 230 penetrates.

A portion of the door opening part 240 is located in the frame 200 and the other portion thereof extends to the outside of the frame 200 through the slot 221.

The lower frame 220 may include seating parts 224 and 225 in which the door opening part 240 is seated.

The seating parts 224 and 225 may include a first seating part 224 and a second seating part 225 provided at different heights.

The first seating part 224 is located at the rear side of the slot 221 to support a portion of the door opening part 240 moving while penetrating through the slot 221.

The height of the upper surface of the first seating part 224 may be equal to or higher than that of the bottom of the slot 221.

The second seating part 225 is located at a height higher than that of the first seating part 224. The second seating part 225 supports a portion of the door opening part 240 moving only inside the frame 200. The portion of the door opening part 240 moving only inside the frame 200 is connected to the connection gear 255, for example.

The door opening part 240 may be linearly and reciprocally moved in a state in which the lower surface of the door opening part 240 is seated in the seating parts 224 and 225.

In some implementations, assume that the door opening part 240 is moved in a front-and-rear direction in order to open the refrigerator door 13 and a left-and-right direction is perpendicular to the front-and-rear direction.

The first seating part 224 and the second seating part 225 may be spaced apart from each other in the left-and-right direction.

The lower frame 220 may further include lower frame guides 226 and 227 guiding linear motion of the door opening part 240 seated in the seating parts 224 and 225.

The lower frame guides 226 and 227 may include a first lower frame guide 226 provided in the first seating part 224 and a second lower frame guide 227 provided in the second seating part 225.

Since the heights of the first seating part 224 and the second seating part 225 are different, the heights of the first lower frame guide 226 and the second lower frame guide 227 are different.

In some implementations, the first lower frame guide 226 and the second lower frame guide 227 are spaced apart from each other in the left-and-right direction.

In some implementations, since the plurality of frame guides 226 and 227 is spaced apart from each other in the direction intersecting the movement direction of the door opening part 240, it is possible to prevent a phenomenon that the door opening part 240 shakes in the left-and-right direction in the process of moving the door opening part 240.

When shaking of the door opening part 240 is reduced, noise may be reduced in the process of moving the door opening part 240 and rotation power of the driving motor 251 delivered to the door opening part 240 may be delivered to the hinge assembly 30 without loss.

The lower frame guides 226 and 227 may be protrusions protruding from the seating parts 224 and 225 upward, for example. In this case, the lower frame guides 226 and 227 may be inserted into the door opening part 240.

As another example, the lower frame guides 226 and 227 may be reception parts depressed downward from the seating parts 224 and 225. In this case, a portion of the door opening part 240 may be inserted into the lower frame guides 226 and 227.

In order to stably guide the door opening part 240, the lower frame guides 226 and 227 may extend in the direction parallel to the movement direction of the door opening part 240.

The lower frame 220 may further include a motor mounting part 228 in which the driving motor 251 is mounted.

The motor mounting part 228 may be located at the rear side of the gear supporter 223. For example, the gear supporter 223 may be located between the motor mounting part 228 and the first seating part 224. The motor mounting part 228 may support some of the plurality of gears 253.

In some implementations, the plurality of gears 253 may be arranged in a line in the front-and-rear direction in a state in which the plurality of gears 253 is supported by the gear supporter 223. Accordingly, the width of the door opening device 20 may be reduced.

In some examples, the size of the refrigerator 10 may be changed according to the capacity of the storage compartment of the refrigerator 10. At this time, change in depth of the refrigerator 10 is greater than change in width of the refrigerator.

In some cases, as the capacity of the storage compartment of the refrigerator 10 is reduced, decrease in depth of the refrigerator 10 is greater than decrease in width of the refrigerator 10. As the width of the door opening device 20 increases, an available space where the door opening device 20 can be mounted may be limited. If the width of the door opening device 20 can be minimized, restriction or limitation in place where the door opening device 20 can be mounted decreases.

Figure 9:
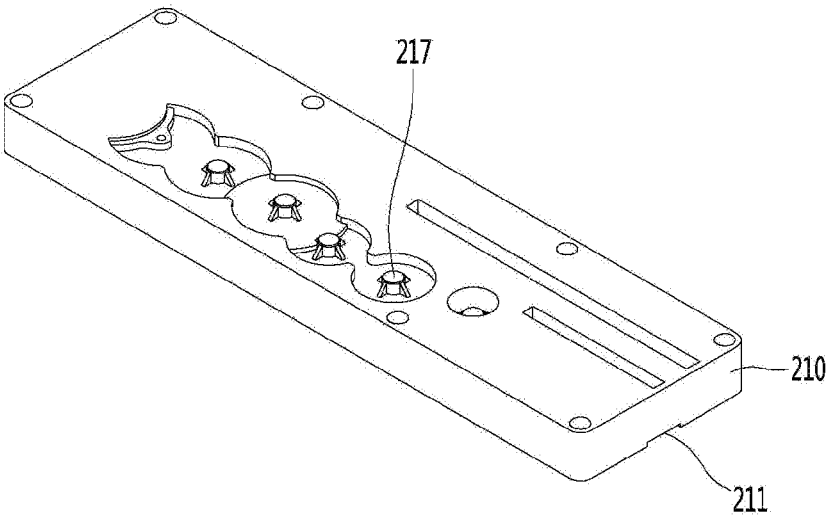
FIG. 9 is a perspective view showing an example upper frame.
Figure 10:
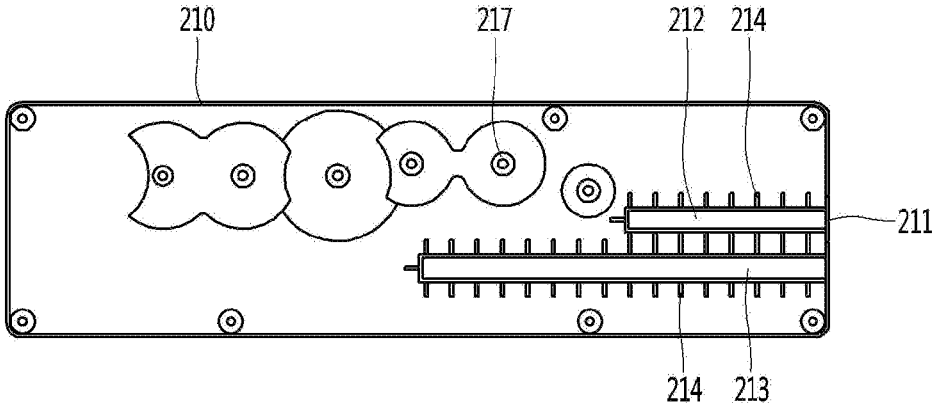
FIG. 10 is a bottom view showing the upper frame of FIG. 9.

FIG. 9 is a perspective view of an upper frame, and FIG. 10 is a bottom view showing the upper frame of FIG. 9.

Referring to FIGS. 3 to 10, the upper frame 210 may be coupled to the lower frame 220 to cover the power delivery part 252 and the door opening part 240 seated in the lower frame 220.

A slot 221 for movement of the door opening part 240 may be formed in the upper frame 210. At this time, the slot 221 may be formed in the lower frame 220 but may not be formed in the upper frame 210.

A plurality of shaft connectors 217 rotatably supporting shafts 257 for rotating the plurality of gears 253 may be provided in the upper frame 210.

In some implementations, the upper frame 210 may include upper frame guides 212 and 213 guiding linear motion of the door opening part 240.

The upper frame guides 212 and 213 may include a first upper frame guide 212 located above the first seating part 224 and a second upper frame guide 123 located above the second seating part 225.

For example, the first upper frame guide 212 may be located above the first lower frame guide 226 and the second upper frame guide 213 may be located above the second lower frame guide 227.

In some implementations, the first upper frame guide 212 and the second upper frame guide 213 may be spaced apart from each other in the left-and-right direction.

The upper frame guides 212 and 213 may be reception parts for receiving portions of the door opening part 240, for example. In this case, the upper frame guides 212 and 213 may include a wall forming a reception space and the wall may be connected with a reinforcement rib 214.

As another example, the upper guides 212 and 213 may be protrusions inserted into the door opening part 240.

If the upper frame guides 212 and 213 and the lower frame guides 226 and 227 are protrusions, the reception parts may be formed in the upper and lower surfaces of the door opening part 240 in order to receive the upper frame guides 212 and 213 and the lower frame guides 226 and 227.

Since the reception parts are formed in the upper and lower surfaces of the door opening part 240, the height of the door opening part 240 may increase in order to provide sufficient strength to the door opening part 240.

In this case, the height of the door opening device 20 increases due to increase in height of the door opening part 240.

In some implementations, the upper frame guides 212 and 213 and the lower frame guides 226 and 227 may be reception parts for receiving portions of the door opening part 240, in order to prevent the height of the door opening device 20 from increasing.

Alternatively, or in addition, any one of the upper frame guides 212 and 213 and the lower frame guides 226 and 227 may be protrusions and the other thereof may be reception parts, in order to prevent the height of the door opening device 20 from increasing.

The upper frame guides 212 and 213 and the lower frame guides 226 and 227 are reception parts, and protrusions that can be received in the upper frame guides 212 and 213 and the lower frame guides 226 and 227 may be formed in the upper and lower surfaces of the door opening part 240. In some cases, the height of the door opening part 240 may increase. However, since the protrusions of the door opening part 240 are received in the guides 212, 213, 226 and 227, the protrusions of the door opening part 240 do not cause space restriction and thus the height of the door opening device 20 does not increase.

In some cases, the weight of the door opening part 240 may increase to increase force required to move the door opening part 240.

In some implementations, any one of the upper frame guides 212 and 213 and the lower frame guides 226 and 227 may be protrusions and the other thereof may be reception parts, in order to prevent force required to move the door opening part 240 and the height of the door opening part 240 from increasing.

Figure 11:
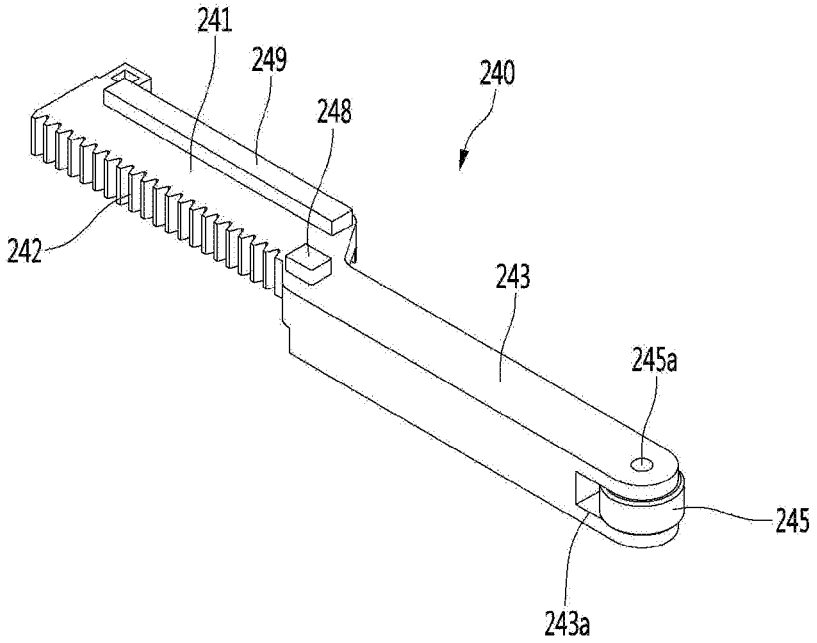
FIG. 11 is a perspective view showing an example door opening part.
Figure 12:
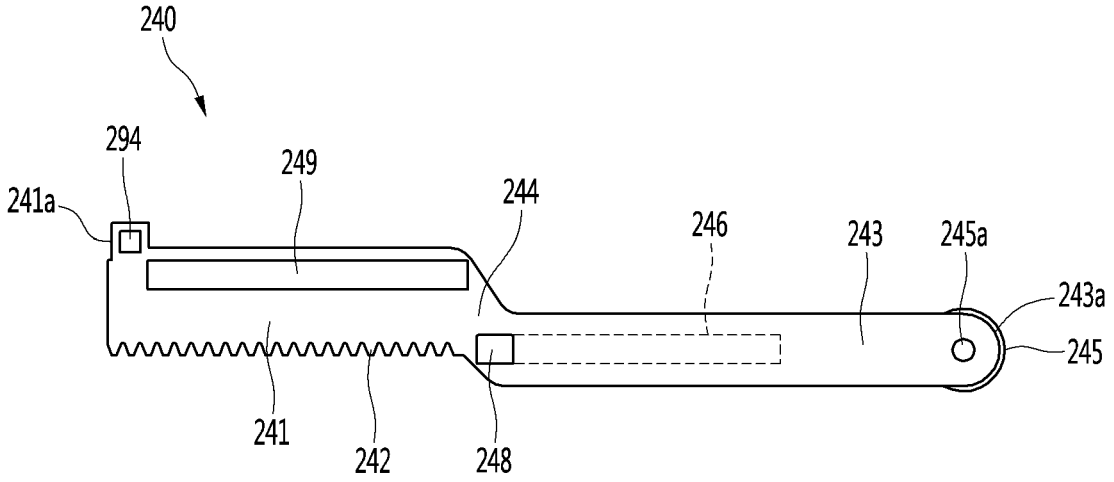
FIG. 12 is a plan view showing the door opening part of FIG. 11.
Figure 13:
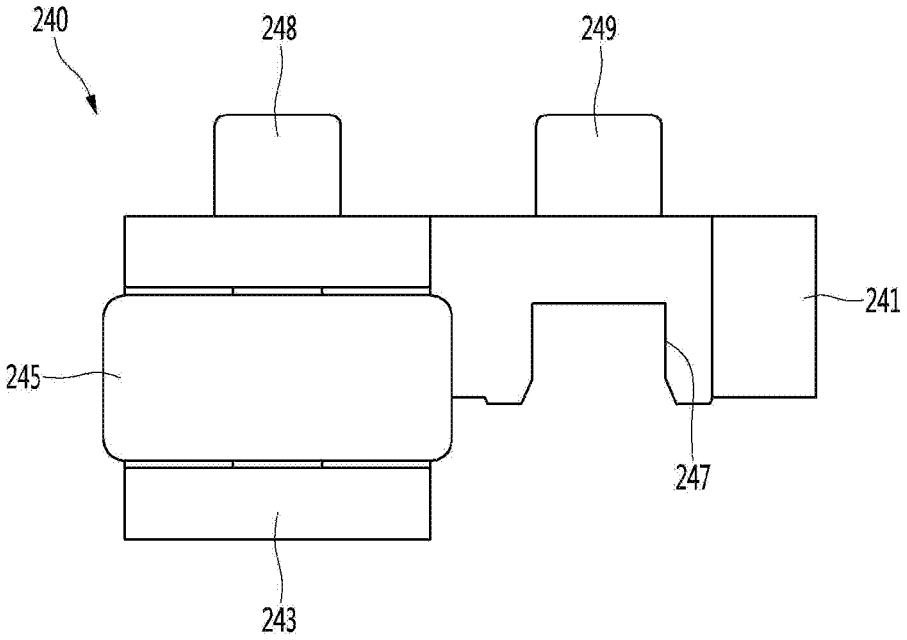
FIG. 13 is a front view showing the door opening part of FIG. 11.

FIG. 11 is a perspective view showing an example door opening part, FIG. 12 is a plan view showing the door opening part of FIG. 11, and FIG. 13 is a front view showing the door opening part of FIG. 11.

Referring to FIGS. 3 to 13, the door opening part 240 may include a rack which receives power from the driving unit 250 and moves in the front-and-rear direction.

The rack may include a first body 241 including a rack gear 242 connected to the connection gear 255, a second body 243 for pushing the hinge assembly 30 and a connection body 244 connecting the first body 241 and the second body 243.

The connection body 244 may extend to be inclined from the first body 241 at a predetermined angle. The second body 243 may extend from the connection body 244 in a direction parallel to the extension direction of the first body 241.

Accordingly, the rack may be bent plurality times in the overall structure.

For example, a portion of the first body 241 overlaps the second body 243 and the other portion of the first body 241 does not overlap the second body 243 in the movement direction (front-and-rear direction) of the door opening part 240.

By the shape of the door opening part 240, the second body 243 may be located at the center of the frame 200 in the width direction of the frame 200 without increasing the width of the door opening device 20. In some implementations, the second body 243 may be located at a center portion of the frame 200 in the width direction. In some examples, the center of the frame 200 may be positioned at the center portion of the frame 200.

For example, referring to FIG. 6, in order to connect the first body 241 to the connection gear 255, the first body 241 may be at the lateral side of the plurality of gears 252. If the rack is not bent but is linearly formed, the rack is not located at the center of the door opening device 20 in the left-and-right direction and is located at one side of the door opening device 20.

The opening direction of the refrigerator door 13 may be changed according to the place where the refrigerator 10 is mounted. For example, in FIG. 2, the hinge assembly 30 is located at the right upper end or left upper end of the refrigerator door 13.

The position of the hinge assembly 30 may be changed according to the opening direction of the refrigerator door 13. In order to automatically open the refrigerator door 13, the position of the door opening device 20 needs to be changed in correspondence to change in position of the hinge assembly 30.

If the rack is not located at the center of the door opening device 20 in the width direction but is located at one side of the door opening device 20, the door opening device 20 may interfere with the peripheral structures of the refrigerator when the position of the door opening device 20 is changed.

For example, in FIG. 2, a distance between the right end of the cabinet 11 and the door opening device 20 in a state in which the second body 243 of the door opening part 240 is located at the right side of the frame 200 in the door opening device 20 may be referred to as a first distance.

If the position of the hinge assembly 30 is changed to the left side of the refrigerator door 13 in the figure, the position of the door opening device 20 may be changed to the left side of the figure.

At this time, a point of the hinge assembly 30 pressurized by the rack is the same.

When the door opening device 20 is moved and mounted leftward, the door opening device 20 may be mounted at a position where the pressurization point of the hinge assembly 30 and the rack are aligned.

In this case, a second distance between the left end of the cabinet 11 and the door opening device 20 is shorter than the first distance. For example, a space between the door opening device 20 and the left end of the cabinet 11 is reduced and thus interference with the peripheral structures may be caused.

In some implementations, the second body 243 of the door opening part 240 may be located at the center of the door opening device 20 in the width direction. In this case, when the position of the door opening device 20 is changed according to change in opening direction of the refrigerator door 13, the distance between the door opening device 20 and the lateral end of the cabinet 11 may be maintained constant. For example, the door opening part 240 may be installed on a left side, a right side, or both sides of the cabinet 11.

Force necessary for the rack to push the hinge assembly 30 is greater than force necessary for the rack to directly push the refrigerator door 13.

Force required to open the door may increase using torque of the driving motor and deceleration ratio of the plurality of gears. However, increase in force increases force applied from the hinge assembly 30 to the rack.

Accordingly, the rack may be formed of metal in order to increase the strength of the rack and to prevent the rack from being damaged.

Since the connection gear 255 is directly connected to the first body 241, the connection gear 255 of the plurality of gears 252 may be formed of the same material as the rack, in order to prevent the connection gear 255 or the rack from being damaged in a process of delivering rotation power from the connection gear 255 to the first body 241.

In some implementations, since the second body 243 directly pushes the hinge assembly 30, the vertical length (or height) of the second body 243 may be greater than that of the first body 241 in order to increase the strength of the second body 243.

The door opening part 240 may further include upper rack guides 247 and 248 interacting with the upper frame guides 212 and 213.

The upper rack guides 248 and 249 may include a first upper rack guide 248 interacting with the first upper guide 212 and a second upper rack guide 249 interacting with the second upper guide 213.

For example, the upper rack guides 248 and 249 may be protrusions protruding from the upper surface of the door opening part 240.

The first upper rack guide 248 and the second upper rack guide 249 may be spaced part from each other in the left-and-right direction.

If the first upper rack guide 248 is a protrusion, the first upper rack guide 248 may be provided at the connection body 244 or at a position adjacent to the connection body 244 at the second body 243, in order to prevent the protrusion from interfering with the frame 200 in the process of moving the door opening part 240.

The second upper rack guide 249 may extend on the upper surface of the first body 241 in the front-and-rear direction, in order to increase the length of the guide.

The length of the second upper rack guide 249 may be greater than that of the first upper rack guide 248.

The door opening part 240 may further include lower rack guides 246 and 247 interacting with the lower frame guides 226 and 227.

The lower rack guides 246 and 247 may include a first lower rack guide 246 interacting with the first lower guide 226 and a second lower rack guide 247 interacting with the first lower guide 226.

For example, the lower rack guides 246 and 247 may be reception parts formed by depressing the lower surface of the door opening part 240 upward.

The first lower rack guide 246 and the second upper rack guide 247 may be spaced apart from each other in the left-and-right direction.

The first lower rack guide 246 may be provided in the second body 243 and the second lower rack guide 247 may be provided in the first body 241.

The second body 243 may be seated in the first seating part 224 and the first body 241 may be seated in the second seating part 225.

Referring to FIG. 13, since a portion of the first body 241 does not overlap a portion of the second body 243 in the front-and-rear direction, the second lower rack guide 247 may be formed in the portion of the first body 241 which does not overlap the second body 243. Accordingly, when the door opening part 240 is moved, the second body 243 can be prevented from interfering with the second lower frame guide 227.

The door opening part 240 may further include a roller 245 rotatably connected to the second body 243. A roller reception part 243*a*, in which the roller 245 is received, may be formed in the front end of the second body 243.

In a state in which the roller 245 is received in the roller reception part 243*a*, a rotation shaft 245*a* may connect the roller 245 and the second body 243.

A portion of the roller 245 may protrude from the front end of the second body 243 forward, in order to prevent the second body 243 from directly contacting the hinge assembly 30.

For example, a distance from the rotation shaft 245*a* to the end 243*a* of the second body 243 may be greater than the radius of the roller 245. In some implementations, the rotation shaft 245*a* of the roller may be parallel with a hinge axis or a contact surface 333 of the of the hinge assembly 30. In some implementations, the rotation shaft 245*a* may be oriented in a different direction and the roller 245 may be a ball type, for instance.

In some cases, when the door opening part 240 is moved, the roller 245 may directly contact the hinge assembly 30.

In some implementations, since the roller 245 contacts the hinge assembly 30 in the process of moving the door opening part 240 in order to open the door, it is possible to reduce friction noise as compared to the case where the rack directly contacts the hinge assembly 30 and to prevent the door opening part 240 from being damaged.

The front end of the second body 243 may be rounded in order to prevent the end of the second body 243 from directly contacting the hinge assembly 30 in the process in which the door opening part 240 pushes the hinge assembly 30.

In some implementations, a magnet mounting part 241*a* in which a magnet 294 is mounted may be provided in the first body 241. As described above, the Hall sensor 292 may sense the magnetic intensity of the magnet 294 to check the position of the door opening part 240.

The magnet mounting part 241*a* may be located at the opposite side of the rack gear 242 in the first body 241, in order to prevent interference with the plurality of gears 252.

Figure 14:
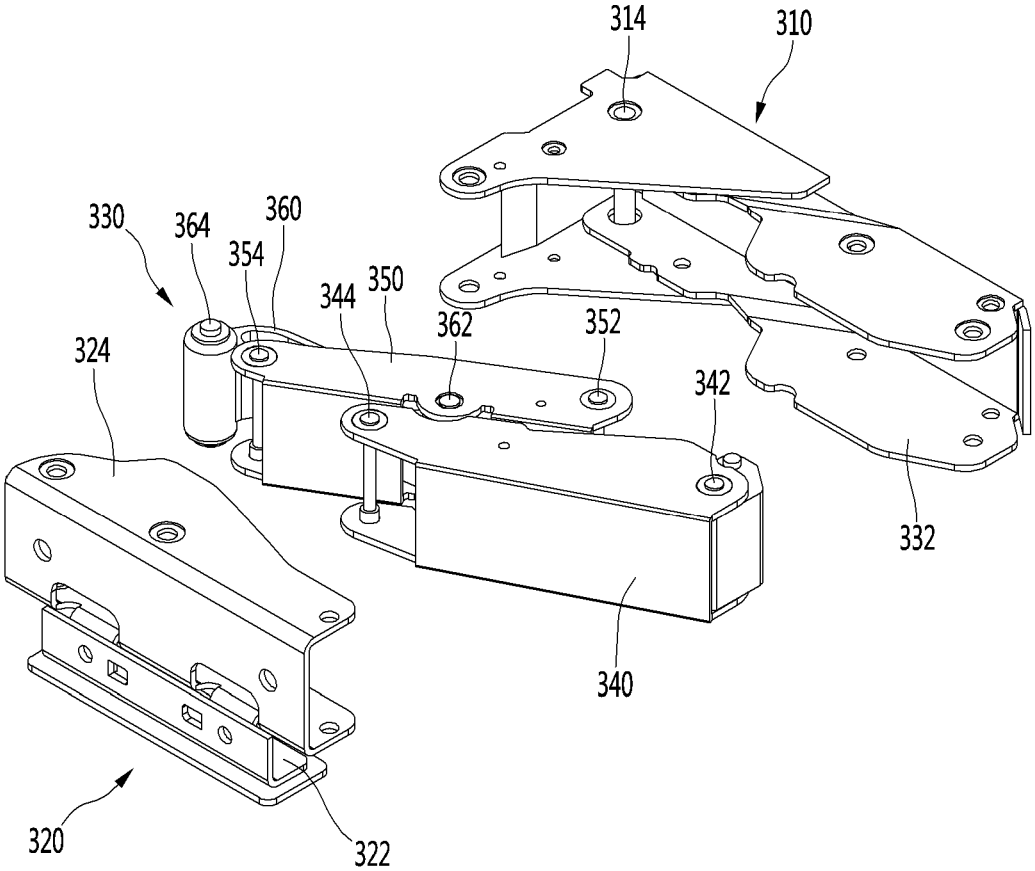
FIG. 14 is an exploded perspective view showing an example hinge assembly.

FIG. 14 is an exploded perspective view showing an example hinge assembly.

Referring to FIGS. 2 and 14, the hinge assembly 30 may include a first hinge frame 310 provided in the cabinet 11, a second hinge frame 320 fixed to the furniture door 2 or the refrigerator door 13 and a link unit 330 connected to the first hinge frame 310 and the second hinge frame 320.

The second hinge frame 320 may include a door fixing part 322 fixed to the refrigerator door 13 and a link connector 324 located above the door fixing part 322 and connected with the link unit 330, for example.

The door opening part 240 pushes the link unit 330 in order to open the refrigerator door 13.

The link unit 330 may include a plurality of links 332, 340, 350 and 360 for receiving pushing force from the door opening part 240, rotating the refrigerator door 13 around a rotation center thereof, opening the storage compartment and moving the rotation center thereof in the horizontal direction.

The link unit 330 may include a first link 332 connected to the first hinge frame 310 by the first hinge 314.

The link unit 330 may further include a second link 340 connected to the first link 332 at a position spaced apart from the first hinge 314. The second link 340 may be rotatably connected to the first link 332 by the second hinge 342.

At this time, a multi joint link rotatably connected with the plurality of members of the second link 340 may be included. In this case, a second hinge 342 may be formed in one of the plurality of members and a sixth hinge 344 may be formed in another of the plurality of members.

The link unit 330 may further include a third link 350 rotatably connected to the first link 332 between the first hinge 314 and the second hinge 342.

The third link 350 may be rotatably connected to the first link 332 by the third hinge 352.

The link unit 330 may further include the third link 350 and a fourth link 360 rotatably connected to the first hinge frame 310.

The fourth link 360 may be rotatably connected to the third link 350 by the fourth hinge 362 and may be rotatably connected to the first hinge frame 310 by the fifth hinge 364.

At this time, the fourth hinge 362 may be closer to the refrigerator door than the first hinge 314.

In some implementations, the second link 340 may be rotatably connected to the second hinge frame 320 by the sixth hinge 344 and the third link 350 may be rotatably connected to the second hinge frame 320 by the sixth hinge 344.

A distance between the sixth hinge 344 and the seventh hinge 354 is less than the distance between the third hinge 352 and the second hinge 342.

The length of the fourth link 360 is less than that of the first link 332.

Figure 15:
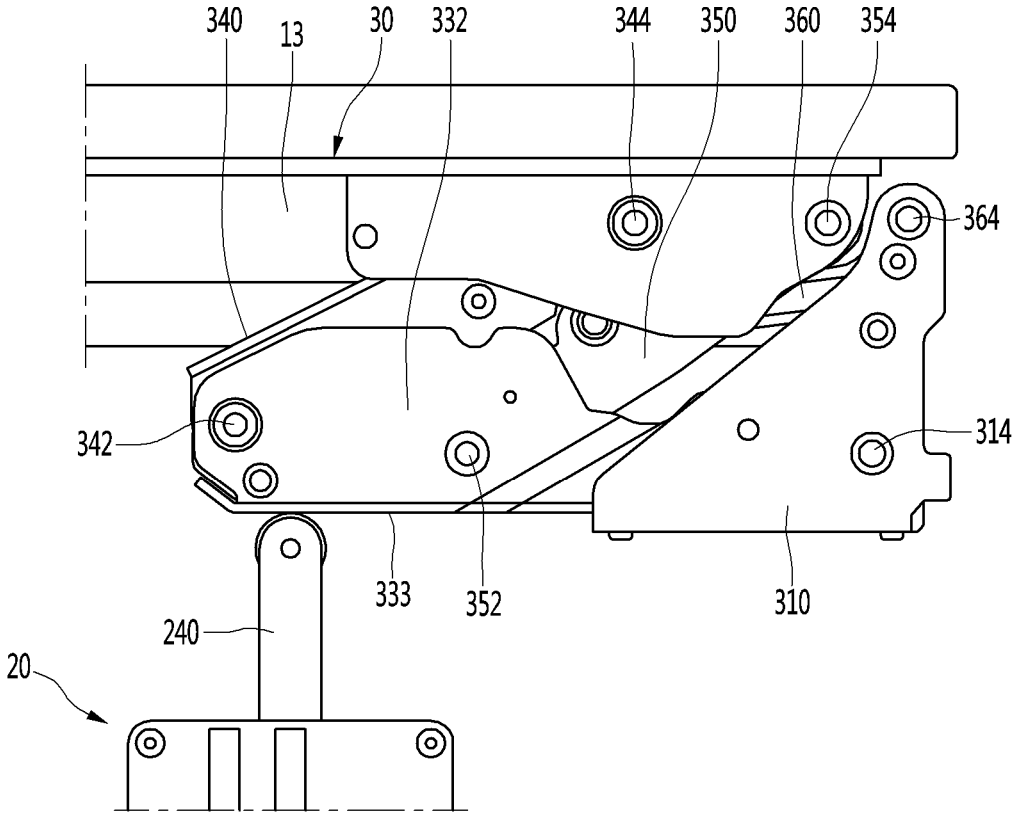
FIGS. 15 to 17 are views showing the states of an example hinge assembly when an example refrigerator door is opened by an example door opening device.
Figure 16:
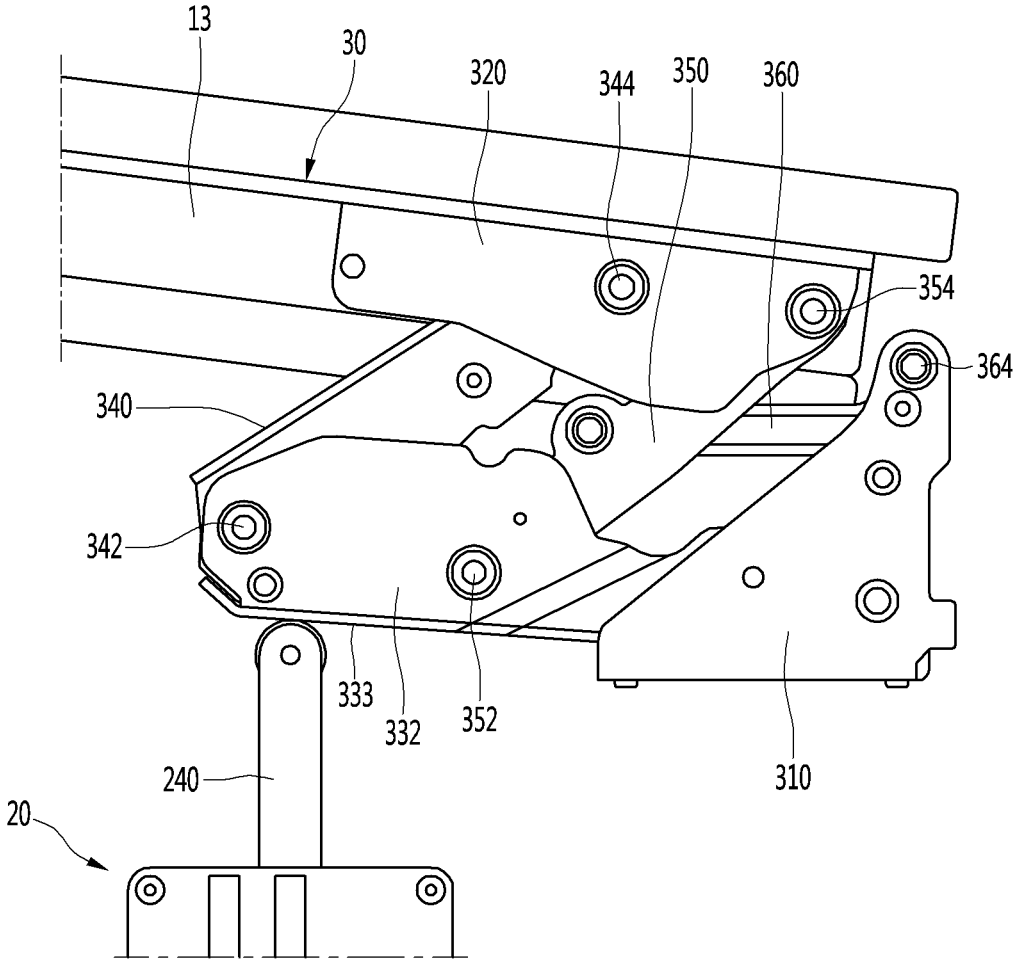
Figure 17:
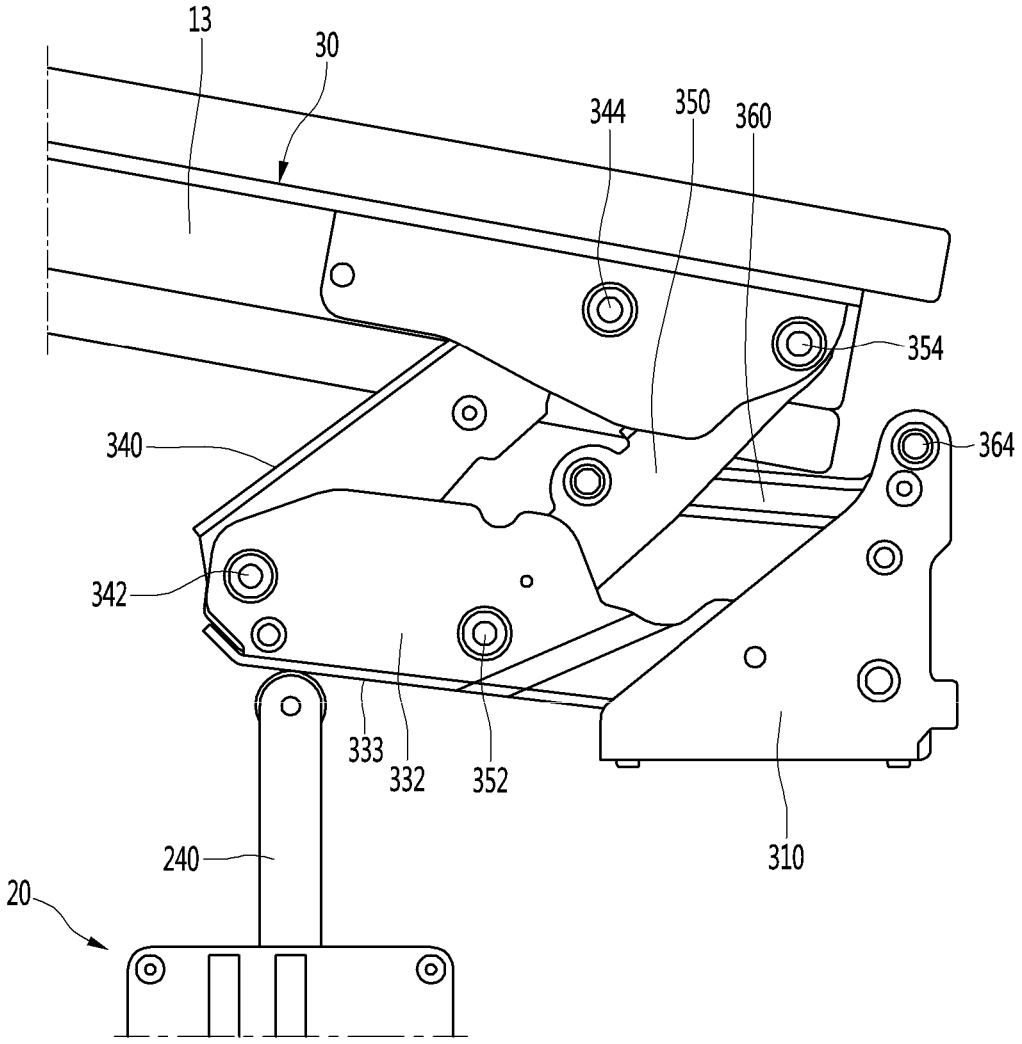

FIGS. 15 to 17 are views showing the state of a hinge assembly when a refrigerator door is opened by a door opening device. FIG. 15 shows a state of closing the refrigerator door.

Figure 18:
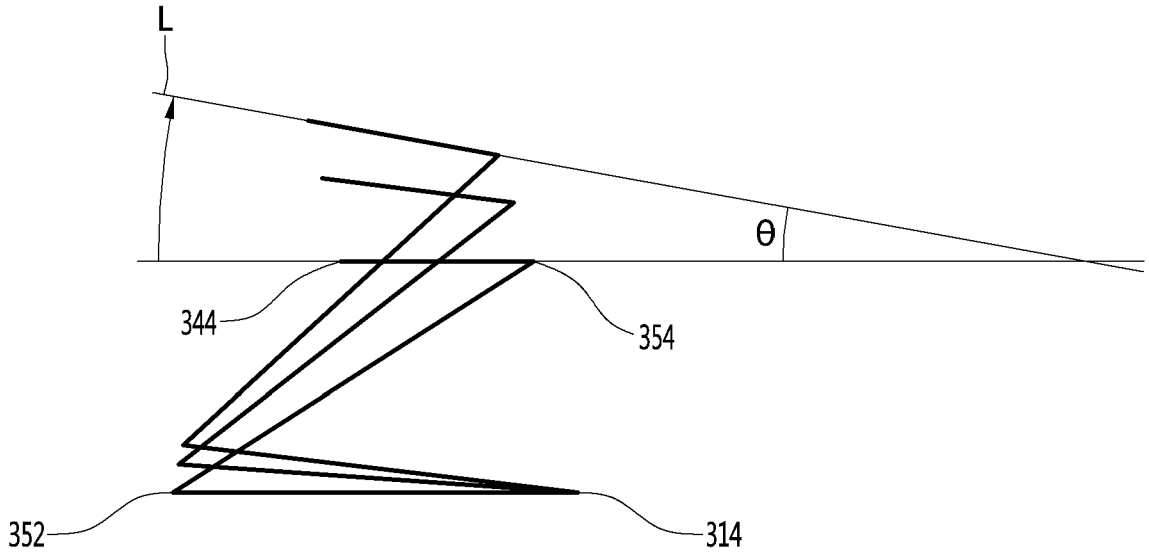
FIG. 18 is a view showing an example trajectory of a line sequentially connecting an example first hinge, an example third hinge, an example seventh hinge, and an example sixth hinge in the hinge assembly of FIGS. 15 to 17.

FIG. 18 is a view showing an example trajectory of a line sequentially connecting a first hinge, a fourth hinge, a seventh hinge and a sixth hinge in the hinge assembly of FIGS. 15 to 17, and FIG. 19 is a view showing an example state in which opening of a refrigerator door is finished.

Referring to FIGS. 2, 5, 6 and 15 to 18, a portion of the door opening part 240 protrudes to the outside of the frame 200 in a state of closing the refrigerator door 13.

The roller 245 of the door opening part 240 may be in contact with the hinge assembly 30. For example, the roller 245 may contact the first link 332. The first link 332 includes a contact surface 333 in contact with the door opening part 240. The contact surface 333 may be parallel to the refrigerator door based on the refrigerator door being closed. The contact surface 333 may include a contact point is positioned closer to the second hinge 342 than the third hinge 352 and the first hinge 314. The contact point may move along the contact surface 333 while the door opening part 240 pushes the first link 332.

The position of the door opening part 240 in the state of closing the refrigerator door may be referred to as an initial position. In some implementations, the roller 245 may be spaced apart from the hinge assembly 30 in a state of closing the refrigerator door 13. In some cases, the roller 245 may contact the hinge assembly 30 in a state of closing the refrigerator door 13.

Since the door opening part 240 contacts the hinge assembly 30, the door opening part 240 is spaced apart from the refrigerator door 13 backward by a predetermined distance. In some implementations, the roller 245 of the door opening part 240 may be spaced apart from the front end 11*a* of the cabinet 11 backward by a predetermined distance.

The driving motor 251 may rotate in a first direction, in order to open the refrigerator door 13. When the driving motor 251 rotates in the first direction, the connection gear 255 may rotate in a clockwise direction in FIG. 6.

Then, the door opening part 240, which has received rotation power from the connection gear 255, pushes the first link 332. For example, the door opening part 240 pushes the first link 332 while moving from the initial position forward.

For example, the door opening part 240 may push a region of the first link 332 between the third hinge 352 and the second hinge 342.

Then, as shown in FIG. 16, the first link 332 rotates around the first hinge 314 in the clockwise direction. In some implementations, the fourth link 360 rotates around the fifth hinge 364 in the clockwise direction.

By rotation of the first link 332 and the fourth link 360 in the clockwise direction, the refrigerator door 13 rotates while moving away from the cabinet 11.

At this time, since the length of the fourth link 360 is less than that of the first link 332, the rotation angle of the first link 332 is greater than that of the fourth link 360 upon rotation of the first link 332. Accordingly, the fourth link 360 serves to increase the rotation angle of the refrigerator door 13 rotating by the first link 332.

Accordingly, the refrigerator door 13 may rotate at an angle greater than the rotation angle of the first link 332.

Referring to FIG. 18, a virtual connection line L connecting the sixth hinge 344 and the seventh hinge 354 is located on the refrigerator door 13 to move along with the refrigerator door 13.

As shown in FIG. 18, as the movement distance of the door opening part 240 increases, the connection line L moves away from the cabinet 11 and rotates by a predetermined angle. The predetermined angle is equal to the opening angle of the refrigerator door 13.

At this time, the connection line L rotates and horizontally moves far away from the cabinet 11.

In a state of closing the refrigerator door 13, the sixth hinge 344 and the seventh hinge 354 are located on a horizontal line or a plane passing through the center of the fifth hinge 364 in parallel to the front surface of the cabinet 11, or may be located closer to the cabinet than the horizontal line or plane. For example, when the refrigerator door 13 is closed, the fifth hinge 364, the sixth hinge 344, and the seventh hinge 354 are located on a common plane parallel with a front surface of the cabinet 11, or the sixth hinge 344 and the seventh hinge 354 are located forward the fifth hinge 364. In addition, as shown in FIGS. 2 and 15, the first hinge 314, the second hinge 342, the third hinge 352, and the contact surface 333 of the first link 332 can be located rearward relative to the front surface of the cabinet 11 in a state in which the refrigerator door 13 is closed.

In contrast, when the refrigerator door 13 is opened, the sixth hinge 344 and the seventh hinge 354 are located farther from the cabinet 11 than the horizontal line passing through the center of the fifth hinge 364. For example, the sixth hinge 344 and the seventh hinge 354 are located at the front side of the horizontal line passing through the center of the fifth hinge 364. In addition, as shown in FIGS. 16-20, the first hinge 314, at least a portion of the second hinge 342, the third hinge 352, and the contact surface 333 of the first link 332 can be located rearward relative to the front surface of the cabinet 11 in a state in which the refrigerator door 13 is opened.

In some implementations, the opening angle of the refrigerator door 13 may be changed according to the size of the refrigerator 10. Regardless of the size of the refrigerator 10, the opening angle of the refrigerator door may be set such that a maximum distance D1 between the rear surface of the refrigerator door 13 and the front surface of the cabinet 11 in a state of opening the refrigerator door 13 is equal to or greater than 120 mm.

Figure 19:
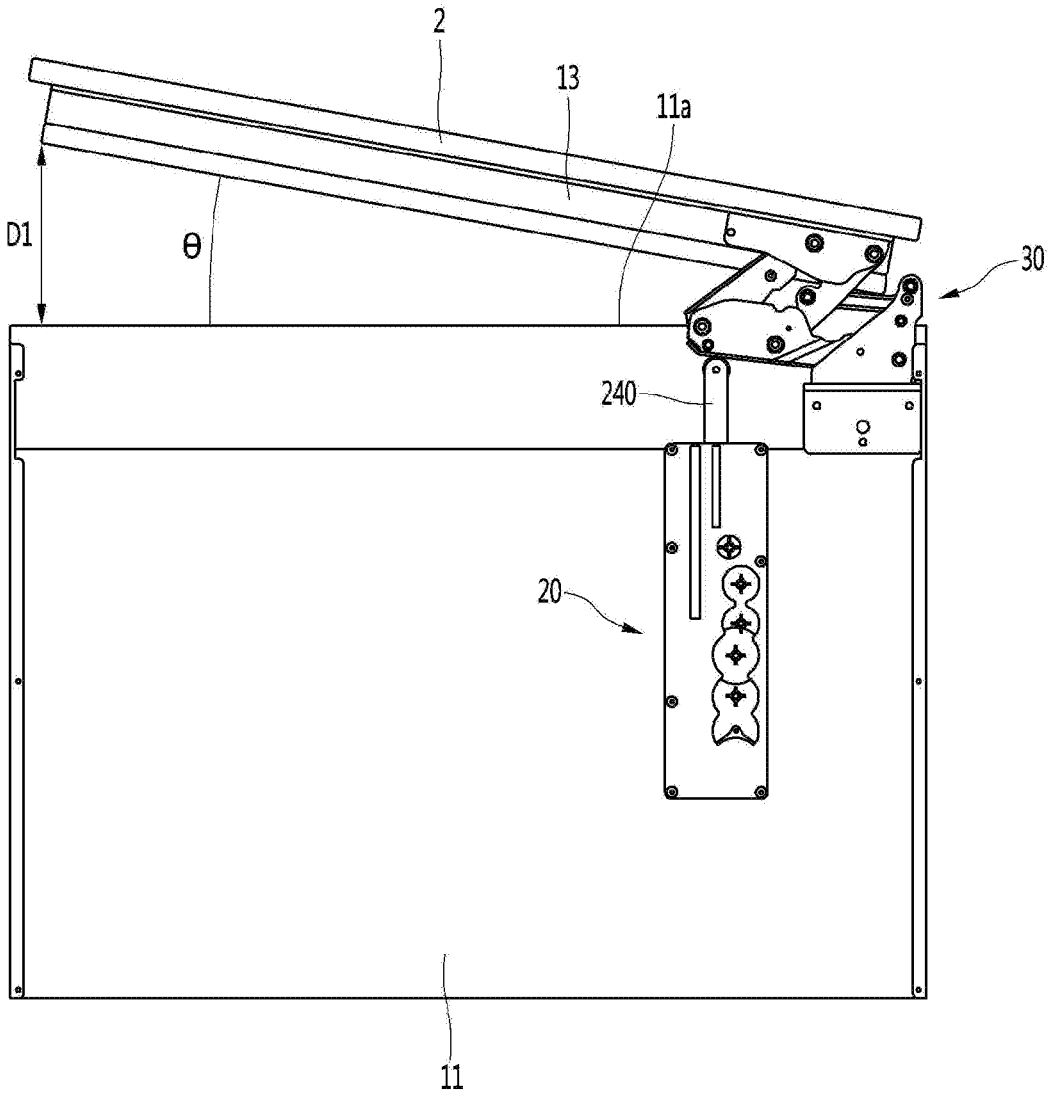
FIG. 19 is a view showing an example state in which opening of an example refrigerator door is finished.

As shown in FIG. 19, the position of the door opening part 240 in the state in which opening of the refrigerator door 13 is finished may be referred to as a door opening position.

In the state in which the door opening part 240 moves to the door opening position, the door opening part 240 entirely overlaps the cabinet 11 in the vertical direction.

For example, in the state in which the door opening part 240 moves to the door opening position, the door opening part 240 is located behind the front surface of the cabinet 11.

Accordingly, even when the door opening part 240 moves to the door opening position, the state in which the door opening part 240 contacts the first link 332 at the rear side of the first link 332 is maintained without protruding to the front side of the cabinet 11.

When the door opening part 240 moves to the door opening position, the driving motor 251 is stopped. When a predetermined time has passed after the driving motor 251 is stopped, the driving motor 251 rotates in a second direction opposite to the first direction and thus the door opening part 240 returns to the initial position.

Since the door opening part 240 pushes the hinge assembly 30 to open the refrigerator door 13, the movement distance of the door opening part 240 for opening the refrigerator door 13 may be reduced.

When the movement distance of the door opening part 240 is reduced, the length of the door opening part 240 may be reduced. In some implementations, even when the length and movement distance of the door opening part 240 are reduced, the opening angle of the refrigerator door 13 may increase by the hinge assembly 30.

In some implementations, since the door opening part 240 is located at the rear side of the hinge assembly 30 in a state of finishing opening of the refrigerator door 13, it is possible to prevent exposure of the door opening part 240.

Figure 20:
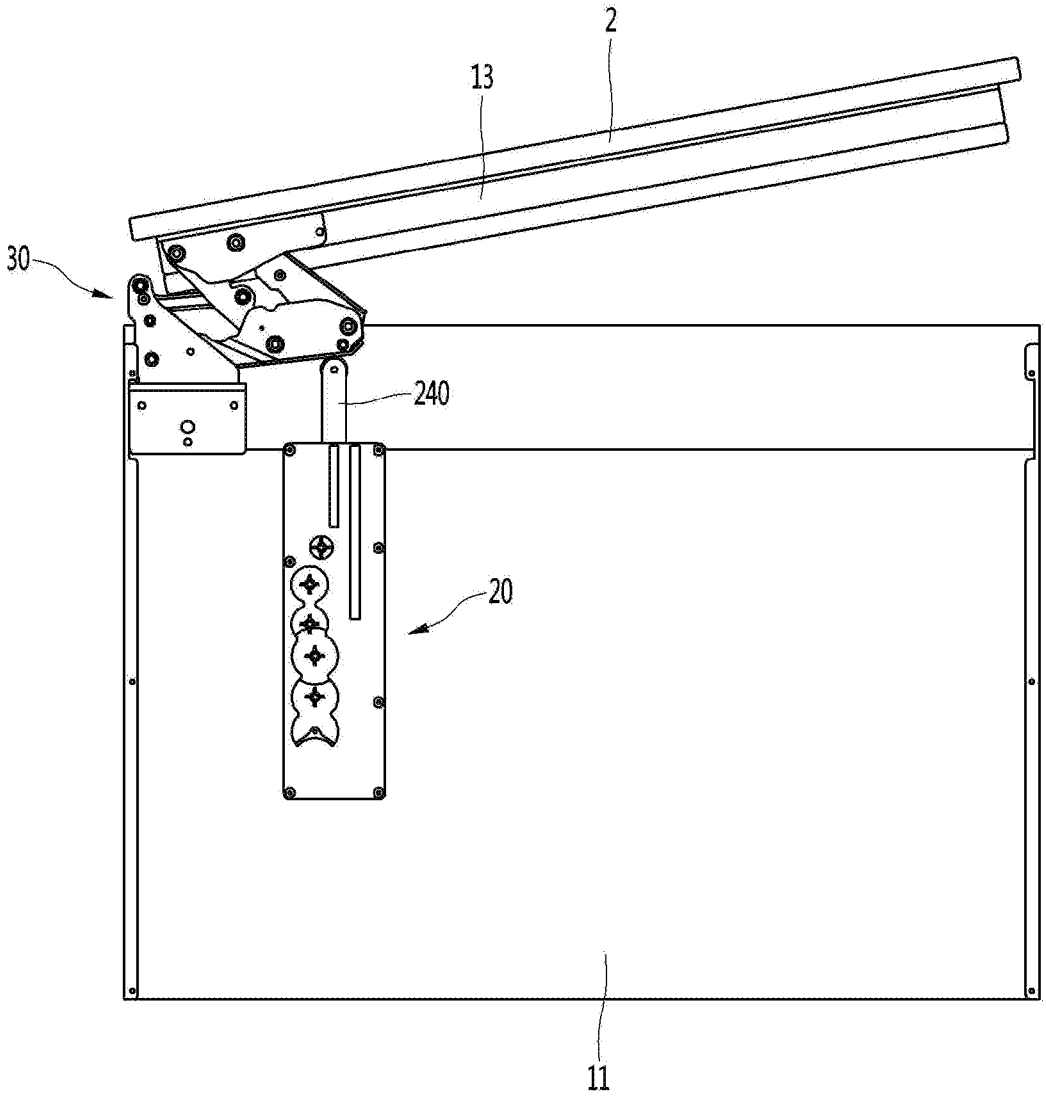
FIG. 20 is a view showing an example state in which the positions of an example hinge assembly and a door opening device are changed.

FIG. 20 is a view showing an example state in which the positions of a hinge assembly and a door opening device are changed.

Referring to FIG. 20, as described above, the positions of the hinge assembly and the door opening device 20 may be changed to change the opening direction of the refrigerator door 13 without changing the structure of the door opening device 20. As described above, since the door opening part is located at the center of the frame 200, only the position of the door opening device 20 may be changed to open the refrigerator door 13.

In some implementations, since the door opening part is located at the center of the frame, only the position of the door opening device may be changed to open the refrigerator door.

In some implementations, since a plurality of guides is formed in the door opening part in the direction intersecting the movement direction of the door opening part and a plurality of guides interacting with the plurality of guides is formed in the frame, it may be possible to prevent the door opening part from shaking in the left-and-right direction in the process of moving the door opening part.

When shaking or vibration of the door opening part is reduced, a noise can be reduced in the process of moving the door opening part and rotation power of the driving motor delivered to the door opening part may be used to open the refrigerator door without loss.

In some implementations, since the roller is provided in the door opening part and the roller contacts an object, the noise caused due to friction between the door opening part and the object may be reduced in the process in which the door opening part pushes the object.

In some implementations, since the door opening part pushes the multi-joint hinge assembly to open the refrigerator door, it is possible to increase the opening angle of the refrigerator door while reducing the length of the door opening part.

In some implementations, since the door opening part is located at the rear side of the hinge assembly in the state of opening the refrigerator door, it is possible to prevent exposure of the door opening part.

What is claimed is:

1. A refrigerator comprising:

a cabinet that defines a storage compartment;

a refrigerator door configured to open and close the storage compartment;

a hinge assembly that couples the refrigerator door to the cabinet, the hinge assembly being connected to an upper surface of the cabinet and comprising a plurality of links; and a door opening device that is disposed at the upper surface of the cabinet and comprises a driving motor and a pushing member, the pushing member being configured to be driven by the driving motor and push one of the plurality of links to thereby open the refrigerator door, wherein the pushing member is configured to move from an initial position to a door opening position to thereby open the refrigerator door, the pushing member, at the initial position, being located rearward relative to the one of the plurality of links and facing the one of the plurality of links.

2. The refrigerator of claim 1, wherein a distance between a front surface of the cabinet and the pushing member is greater than a distance between the front surface of the cabinet and the one of the plurality of links.

3. The refrigerator of claim 2, wherein the one of the plurality of links includes a contact surface configured to be in contact with the pushing member while the pushing member moves from the initial position to the door opening position, and wherein the contact surface is positioned rearward relative to the front surface of the cabinet based on the pushing member being positioned at the initial position.

4. The refrigerator of claim 3, wherein the plurality of links comprise:

a first link rotatably coupled to the cabinet by a first hinge; and a second link rotatably coupled to the refrigerator door, and wherein the pushing member is configured to push the first link to open the refrigerator door.

5. The refrigerator of claim 4, wherein the first link covers at least a portion of the upper surface of the cabinet based on the pushing member being positioned at the door opening position.

6. The refrigerator of claim 5, wherein the second link covers at least a portion of the upper surface of the cabinet based on the pushing member being positioned at the door opening position.

7. The refrigerator of claim 4, wherein the second link is rotatably connected to the first link by a second hinge, and wherein the first hinge and the second hinge are positioned rearward relative to the front surface of the cabinet based on the pushing member being positioned at the initial position.

8. The refrigerator of claim 7, wherein the first hinge and the second hinge are positioned rearward relative to the front surface of the cabinet based on the pushing member being positioned at the door opening position.

9. The refrigerator of claim 7, wherein the plurality of links further comprises a third link rotatably connected to the first link by a third hinge, the third hinge being disposed between the first hinge and the second hinge, and wherein the first link includes a contact point that is configured to be in contact with an end of the pushing member at the contact surface while the pushing member is driven by the driving motor, the contact point is positioned closer to the second hinge than to the third hinge.

10. The refrigerator of claim 9, wherein the second hinge and the third hinge are positioned rearward relative to the front surface of the cabinet based on the pushing member being positioned at the initial position.

11. The refrigerator of claim 9, wherein the second hinge and the third hinge are positioned rearward relative to the front surface of the cabinet based on the pushing member being positioned at the door opening position.

12. The refrigerator of claim 9, wherein the hinge assembly further comprises:

a first hinge frame connected to the upper surface of the cabinet; and a second hinge frame connected to the refrigerator door.

13. The refrigerator of claim 12, wherein the first link is rotatably connected to the first hinge frame, and wherein the second link rotatably connects the first link to the second hinge frame.

14. The refrigerator of claim 13, wherein the third link is rotatably connected to the first link and to the second hinge frame.

* * * * *